US006751438B2

(12) United States Patent
Seo

(10) Patent No.: US 6,751,438 B2
(45) Date of Patent: Jun. 15, 2004

(54) PAPER FEEDING APPARATUS AND METHOD FOR USE IN A PRINTER

(75) Inventor: In-sik Seo, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/127,441

(22) Filed: Apr. 23, 2002

(65) Prior Publication Data

US 2003/0063935 A1 Apr. 3, 2003

(30) Foreign Application Priority Data

Sep. 29, 2001 (KR) ..... 2001-60981

(51) Int. Cl.[7] ..... G03G 15/00
(52) U.S. Cl. ..... 399/401; 399/402
(58) Field of Search ..... 271/291, 303; 399/364, 381, 401, 402

(56) References Cited

U.S. PATENT DOCUMENTS 4,990,965 A * 2/1991 Kiya ..... 399/401

* cited by examiner

*Primary Examiner*—Hoang Ngo
(74) *Attorney, Agent, or Firm*—Staas & Halsey LLP

(57) ABSTRACT

A paper feeding apparatus for use in a printer includes a sheet feeding path between a sheet feeding section and a developing section, a sheet ejecting path disposed such that a sheet on which an image is printed at the developing section is fed via a fixing section, an ejecting roller, and a reversing path to feed a sheet diverging from the ejecting path to the sheet feeding path again. The apparatus further includes a reversing tray disposed between the ejecting path and the reversing path to reverse the fed sheet, and a guide member rotatably mounted between the ejecting path and the reversing tray, to direct the sheet to the ejecting path or to the reversing tray. The guide member guides the reversed sheet from the reversing tray to the reversing path.

22 Claims, 11 Drawing Sheets

PAPER FEEDING APPARATUS AND METHOD FOR USE IN A PRINTER

CROSS-REFERENCE TO RELATED APPLICATIONS

This application claims the benefit of Korean Application No. 2001-60981, filed Sep. 29, 2001, in the Korean Industrial Property Office, the disclosure of which is incorporated herein by reference.

BACKGROUND OF THE INVENTION

1. Field of the Invention

The present invention relates to a paper feeding apparatus and method of use in a printer, and more particularly, to a paper feeding apparatus and method capable of printing images on both sides of a sheet of paper by improving a feeding path of the sheet of paper.

2. Description of the Related Art

Referring to FIG. 1, in a conventional printer, a paper supplying cassette 11 in which paper is stacked is installed at the bottom of a main body 10. The paper in the cassette 11 is picked-up, sheet by sheet, by a pick-up roller 12. The picked-up sheet is transferred along a predetermined feeding path P1 to a developing section 15 by a feeding roller 13. The developing section 15 comprises an electrification roller 17, a photosensitive roller 16, a developing roller 18 and a transfer roller 19. The photosensitive roller 17 is electrified to a desired electric potential by the electrification roller 16, and electrostatic latent images, which correspond to the desired images, are formed on the electrified surface by a laser scan unit 20. Toner supplied by the developing roller 18 is transferred to the electrostatic latent area. The formed toner image is transferred and printed to a sheet moving between the photosensitive roller 17 and the transfer roller 19.

The image printed on the sheet is fixed at a high temperature while passing through a fixing section 21, and the sheet is ejected along an ejecting path P2 to the exterior of the main body 10 by an ejecting roller 22.

In the case of duplex printing, the sheet, on one side of which an image is printed, is fed along the ejecting path P2 such that a trailing end is held by the ejecting roller 22. The sheet is then fed along a reversing path P3 by counter rotation of the ejecting roller 22. There is a guide member 23 to guide the feed direction of the sheet between the ejecting path P2 and the reversing path P3.

The sheet delivered to the reversing path P3 is again fed along the feeding path P1 by the pick-up roller 12 and the feeding roller 13, to the developing section 15, where an image is printed on the other side of the sheet. Further, the duplex printed sheet is ejected through the fixing section 21 and the ejecting path P2 to the exterior of the main body 10.

In the conventional printer in the case of duplex printing, the first sheet is fed along the feeding path P1 and an image is formed on one side thereof at the developing section 15. Subsequently, it is again fed along the ejecting path P2, the reversing path P3 and the feeding path P1 to the developing section 15 to print an image on the other side thereof. Therefore, it takes a relatively long time to print images on both sides of the sheet, resulting in low printing speed.

In order to solve the above problems, shortening the feeding path of the sheet has been considered, however, this method causes the sheet to be heated at a high temperature by the fixing section 21. This causes the surface temperature of the photosensitive roller 17 to increase, thereby affecting the toner, which is sensitive to temperature. Thus, the function of the toner is adversely affected.

SUMMARY OF THE INVENTION

Accordingly, it is an object of the present invention to provide a paper feeding apparatus and method of use in a printer, which is capable of increasing the efficiency printing.

Additional objects and advantages of the invention will be set forth in part in the description which follows and, in part, will be obvious from the description, or may be learned by practice of the invention.

The foregoing and other objects of the present invention are achieved by providing a paper feeding apparatus for use in a printer, including a sheet feeding path between a sheet feeding section and a developing section; a sheet ejecting path disposed such that a plurality of sheets on which an image is printed at the developing section is fed to the sheet ejecting path via a fixing section and an ejecting roller; a reversing path to feed the sheets from the sheet ejecting path to the sheet feeding path; a reversing tray disposed between the sheet ejecting path and the reversing path to feed the sheets from the reversing path to the sheet feeding path; and a guide member rotatably mounted between the sheet ejecting path and the reversing tray, to direct the sheets to the sheet ejecting path or the reversing tray and to guide the sheet from the reversing tray to the reversing path.

The foregoing and other objects of the present invention are also achieved by providing a paper feeding method to duplex print in a printer, the method including: sequentially feeding a plurality of sheets including an $n^{th}$ paper unit from a sheet supplying section to a developing section; printing images at the development section on a first side of the sheets including the $n^{th}$ paper unit; sequentially reversing the printed sheets; feeding the reversed sheets to the developing section at an interval; feeding sheets including an $n+1^{th}$ paper unit, interposed between adjacent ones of the reversed sheets of the $n^{th}$ paper unit; and printing images at the development section on a second side of the sheets including the $n^{th}$ paper unit and ejecting the printed sheets, to an exterior of the printer.

BRIEF DESCRIPTION OF THE DRAWINGS

These and other objects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
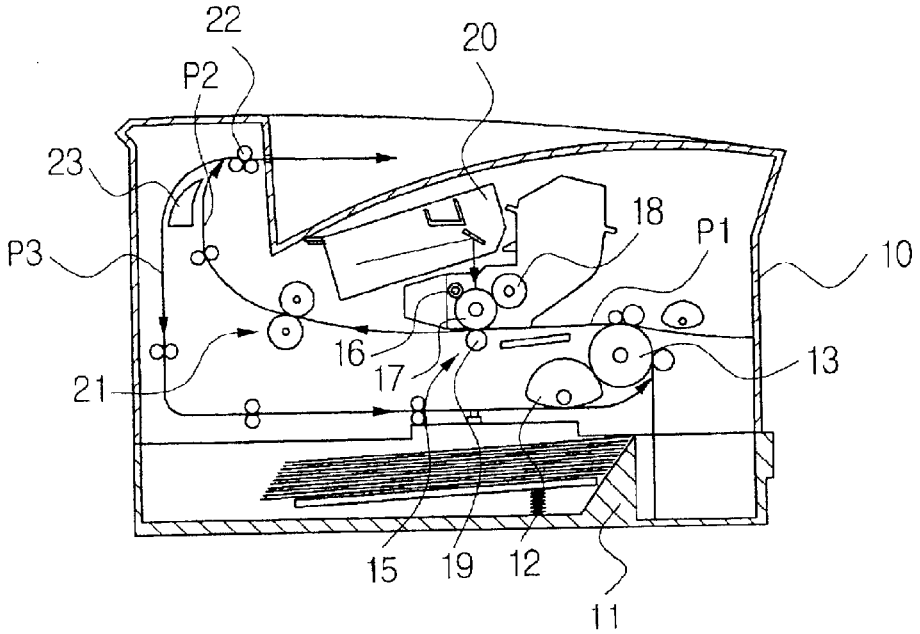
FIG. 1 (PRIOR ART)
FIG. 1 is a schematic view of a conventional printer.

Reference will now be made in detail to the present preferred embodiments of the present invention, examples of which are illustrated in the accompanying drawings, wherein like reference numerals refer to like elements throughout.

Figure 2A:
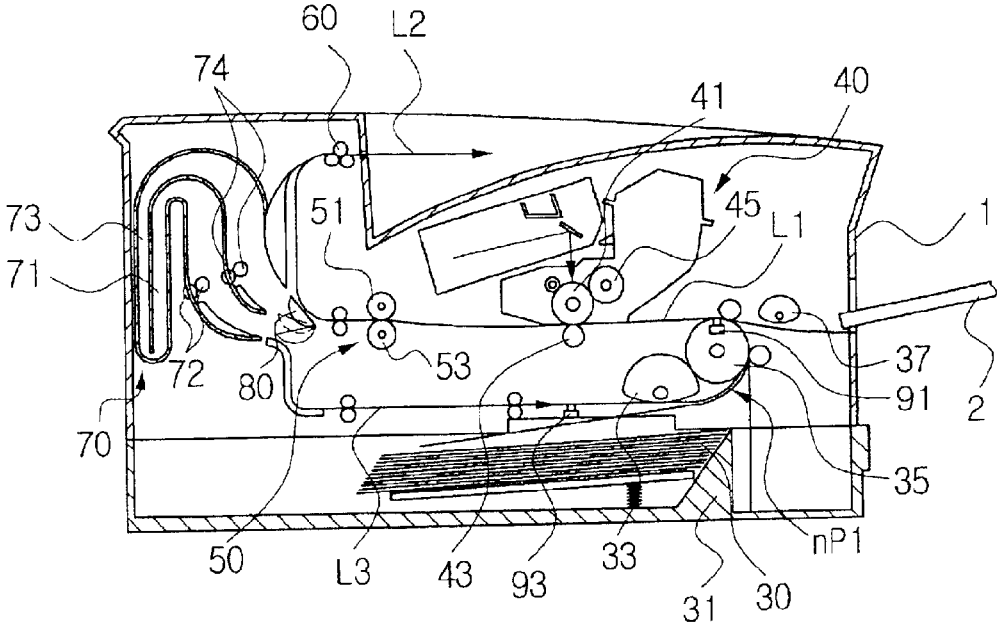
FIG. 2A is a schematic view of a paper feeding apparatus in accordance with an embodiment of the present invention.

Referring to FIG. 2A, a paper feeding apparatus in accordance with an embodiment of the present invention includes a sheet feeding path L1 between a sheet feeding section 30 and a developing section 40 and a sheet ejecting path L2 disposed such that a sheet, on which an image is printed at the developing section 40, is fed via a fixing section 50 and an ejecting roller 60. The paper feeding apparatus further includes a reversing path L3 to feed a sheet diverging from the ejecting path L2 to the sheet feeding path L1 again, a reversing tray 70 and a guide member 80 disposed between the ejecting path L2 and the reversing path L3 to reverse the sheet.

Furthermore, the sheet feeding section 30 includes a sheet supplying tray 31 in which paper is stacked; a pick-up roller 33 to pick up a sheet of paper from the sheet supplying tray 31; and a feeding roller 35 to forward the picked-up sheet to the sheet feeding path L1. In addition, the sheet feeding section 30 further includes a pick-up roller 37 to pick up a sheet fed through a sheet supplying tray 2 disposed at a side wall of a main body 1 of the printer.

The developing section 40 is similar to the developing section 15 of the conventional electrophotographic printer and includes a photosensitive roller 41, a transfer roller 43, and a developing roller 45.

The sheet feeding path L1 is a path from the sheet feeding section 30 to the developing section 40. On the sheet feeding path L1, a plurality of sheet feeding rollers and a guide member, not shown, are disposed. Furthermore, on the sheet feeding path L1, a first sensor 91 to detect a moving sheet, i.e., a sheet forwarded to the developing section 40, is disposed.

The sheet ejecting path L2 is a path to eject the sheet, on which an image is printed at the developing section 40, to the exterior of the main body 1. Disposed on the ejecting path L2 is the fixing section 50 including a heating roller 51 and a backup roller 53, contacting and rotating with the heating roller 51. The sheet, on which an image is printed at the developing section 40, is compressed under high temperature while passing through the fixing section 50, thereby drying and fixing the toner transferred to the side of the sheet.

The reversing path L3 is provided to feed the reversed sheet to the sheet feeding path L1 for duplex printing, from among the sheets moving along the sheet feeding path L1 to the sheet ejecting path L2. Disposed at a certain position on the reversing path L3 is a second sensor 93 to detect a sheet to be fed again at a preparation position where the sheet stands by before it is fed to the sheet feeding path L1 again. That is, when the sheet reversed along the reversing path L3 is detected by the second sensor 93, the reversed sheet stands by before being fed to the sheet feeding path L1 again.

The reversing tray 70 includes a first tray 71 in which an odd numbered sheet is introduced and reversed; and a second tray 73 in which an even numbered sheet is introduced and reversed. The inlets of each of the trays 71, 73 are connected to the ejecting path L2. Furthermore, bi-directional rotatable feeding rollers 72, 74 to introduce and reverse the sheet are installed on the trays 71, 73.

The guide member 80 is rotatably mounted between the ejecting path L2 and the reversing tray 70. The guide member 80 directs the sheet to the ejecting path L2 or the reversing tray 70, depending on a posture of the guide member 80. Furthermore, the guide member 80 directs the sheet reversed from the reversing tray 70 to the reversing path L3.

Figure 2B:
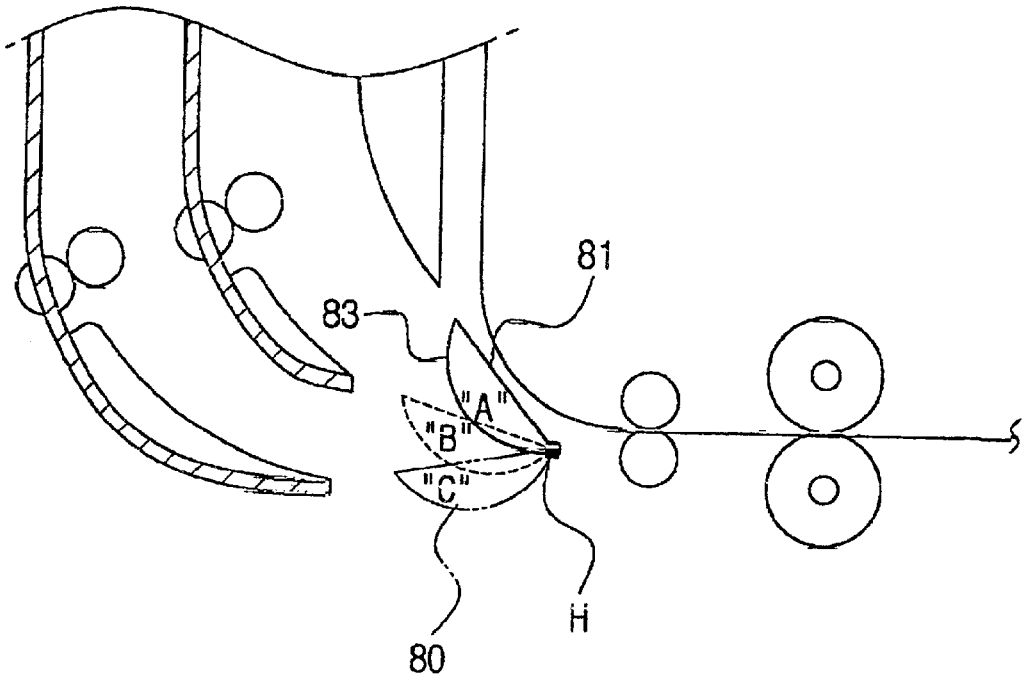
FIG. 2B is a view of a portion of the printer shown in FIG. 2A.
Figure 3:
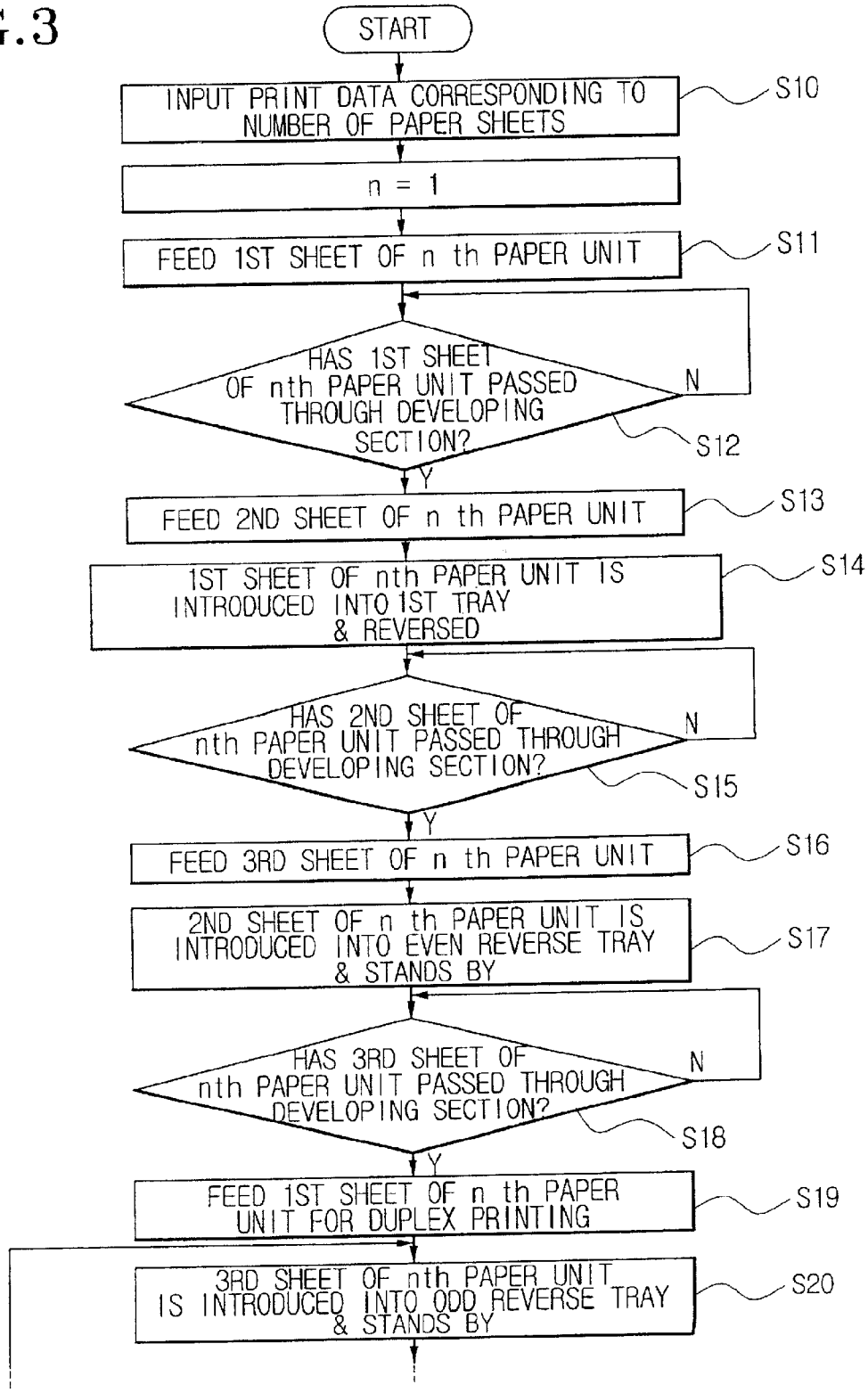
FIGS. 3 to 6 are flow charts showing a paper feeding process using the paper feeding apparatus shown in FIG. 2.
Figure 4:
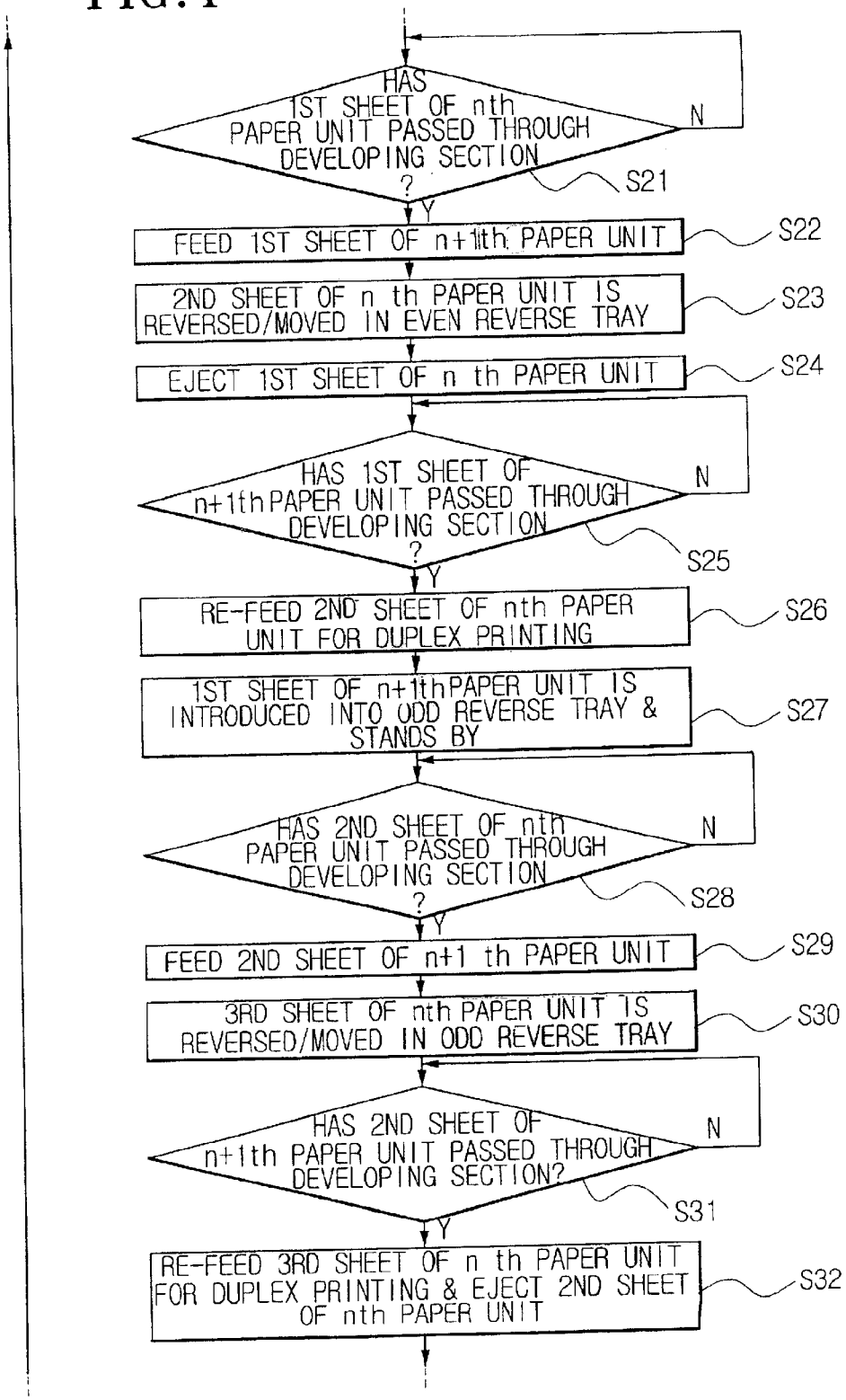
Figure 5:
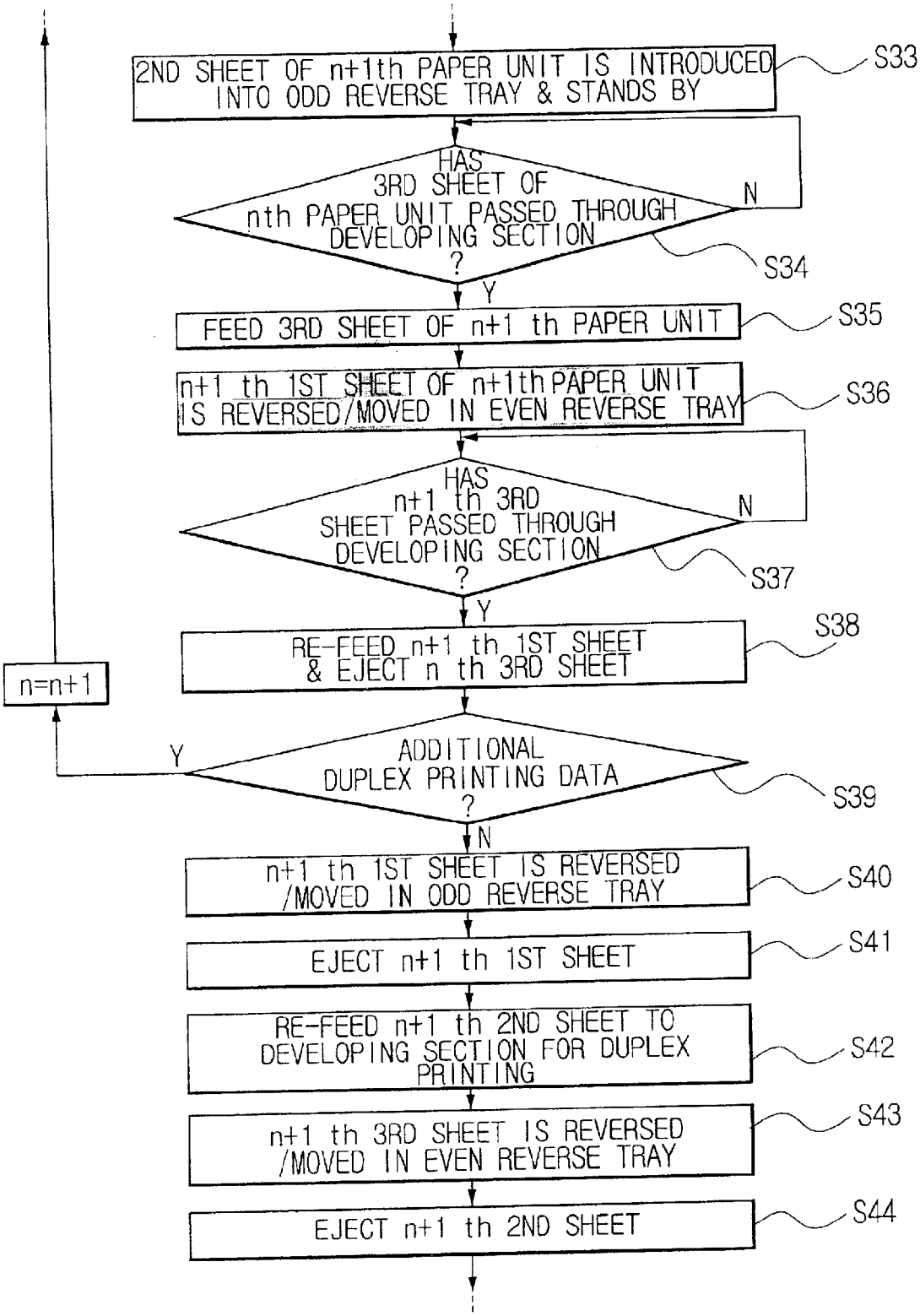
Figure 6:
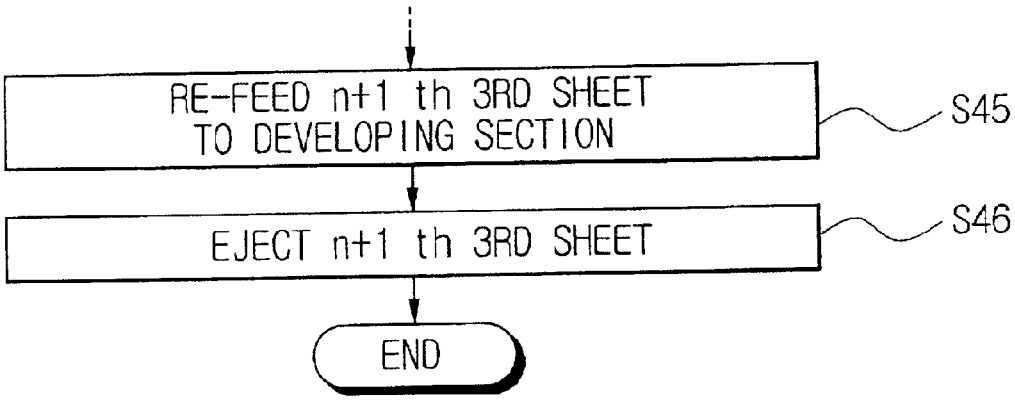

The guide member 80 is of a substantially semi-circular shape, as shown in FIG. 2B, and has a flat first surface 81 and a round second surface 83, located below the first surface 81. The first surface 81 guides the sheet to either the ejecting path L2 or one of the first and second trays 71, 73. The second surface 83 guides the sheet, introduced in each of the trays 71, 73 and reversed, to the reversing path L3. The guide member 80 is rotated by a certain angle about a hinge H and is positioned at a first position A, a second position B, or a third position C according to the rotation angle. At the first position A, the guide member 80 guides the moving sheet to the ejecting path L2, at the second position B to the first tray 71, and at the third position C to the second tray 73. The guide member 80 is rotated between positions A, B and C by a driving unit such as a bi-directional stepping motor (not shown).

The paper feeding process using the paper feeding apparatus for use in a printer, in accordance with this embodiment of the present invention, will now be described. Referring to FIGS. 2A and 3 to 6, printing data corresponding to the number of papers is input to the printer (S10). The input number of the papers is divided into paper units including a plurality of sheets. In this embodiment, the paper unit has three sheets.

Figure 7:
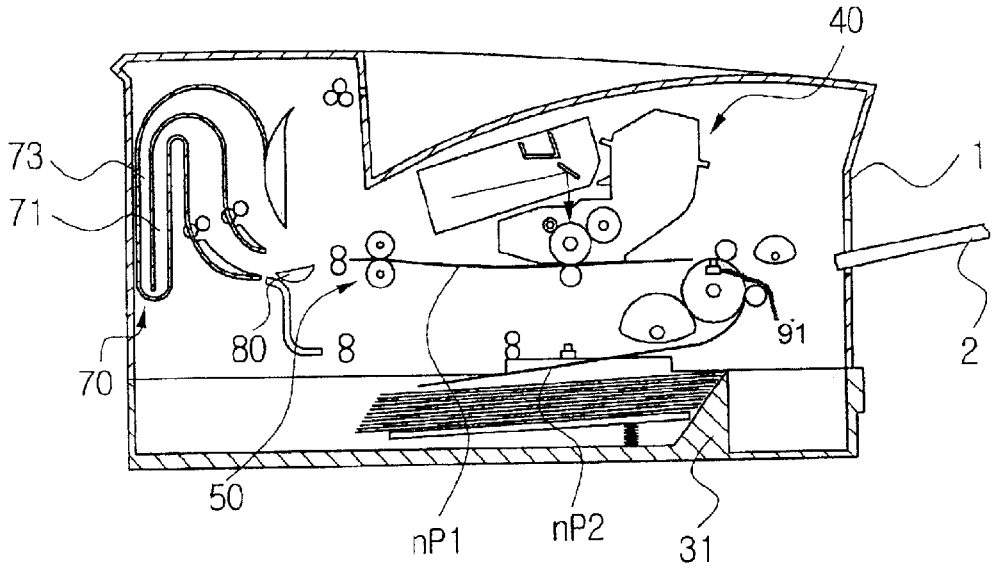
FIGS. 7 to 16 are schematic views showing the operation of the paper feeding apparatus of the present invention.
Figure 8:
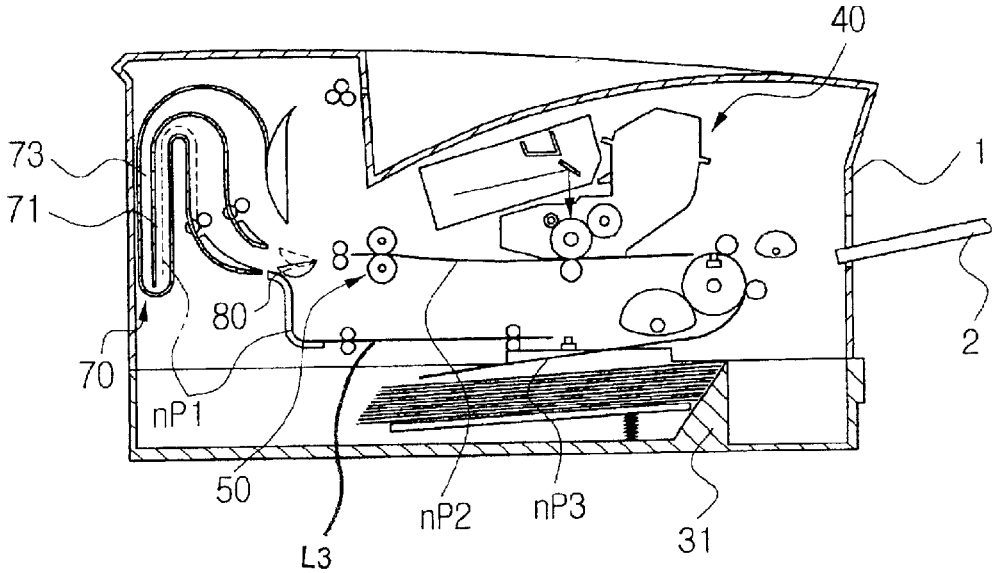
Figure 9:
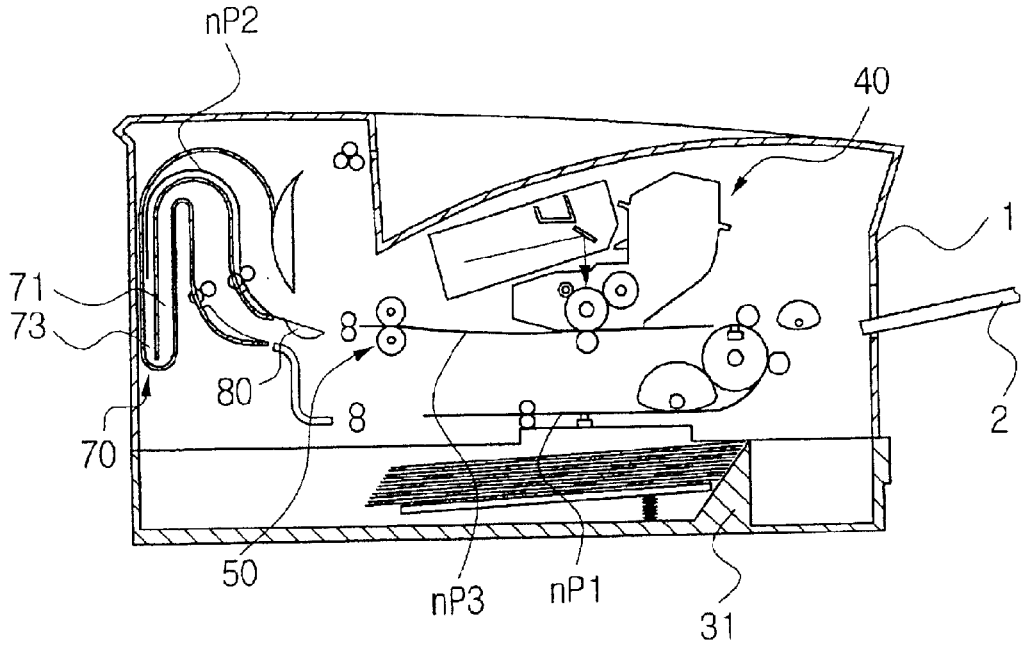

Depending on the printing data inputted, the first sheet nP1$^{th}$ of the n$^{th}$ paper unit is fed from the sheet supplying tray 31 to the feeding path L1 (S11). Then, as shown in FIG. 7, the first sensor 91 determines whether or not the first sheet nP1 has passed through the developing section 40 (S12). If in step 12 it is determined that the first sheet nP1 has passed, a second sheet nP2 of the n$^{th}$ paper unit is fed from the sheet supplying tray 31 to the feeding path L1 (S13). Next, an image is printed on one side of the first sheet nP1 at the developing section 40, and the first sheet nP1 is fed via the fixing section 50, as shown in FIG. 8. The first sheet nP1 is then introduced into the first tray 71 and immediately reversed to the reversing path L3 (S14). The first sheet nP1 is then delivered along the reversing path L3 and stopped to stand by after the second sensor 93 detects the leading end of the first sheet nP1. The first sensor 91 determines whether or not the second sheet nP2 has passed through the developing section 40 (S15), and if the second sheet nP2 has passed, a third sheet nP3 of the n$^{th}$ paper unit is fed from the sheet supplying tray 31 (S16). Subsequently, as shown in FIG. 9, the second sheet nP2 is introduced into the even reverse tray, i.e., the second tray 73, and stands by for a certain period (S17). If it is determined by the first sensor 91 that the third sheet nP3 has passed through the developing section 40 (S18), the waiting first sheet nP1 on the reversing path L3 is again fed to the feeding path L1 for duplex printing (S19).

Figure 10:
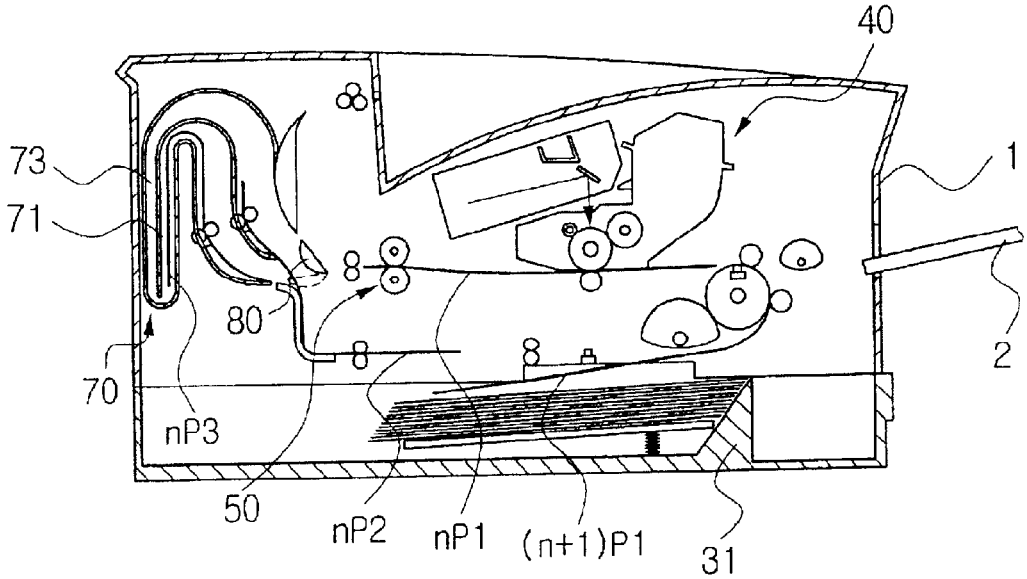

Subsequently, as shown in FIG. 10, the third sheet nP3 is introduced into the odd reverse tray, i.e., the first tray 71, and waits for a certain period (S20). The first sensor 91 determines whether or not the first sheet nP1 (S21) has passed therethrough, and if it is determined that the first sheet nP1 has passed through, the first sheet of n+1$^{th}$ paper unit n+1P1 is fed from the sheet supplying tray 31 (S22). The second sheet nP2 is reversed at the second tray 73 and delivered to the reversing path L3 (S23).

Figure 11:
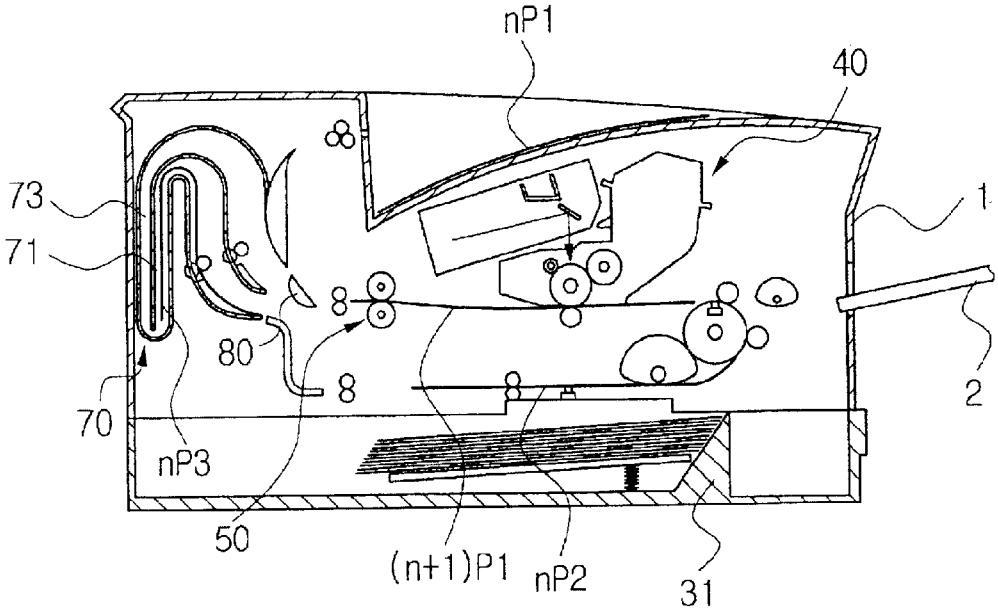

Furthermore, as shown in FIG. 11, the first sheet nP1, which has been fed again and subjected to duplex printing, is ejected along the ejecting path L2 to the exterior of the printer (S24). Then, when the first sensor 91 confirms the passage of the first sheet n+1P1 of the n+1$^{th}$ paper unit (S25), the second sheet nP2 standing by on the reversing path L3 for duplex printing is again fed to the feeding path L1 (S26).

Figure 12:
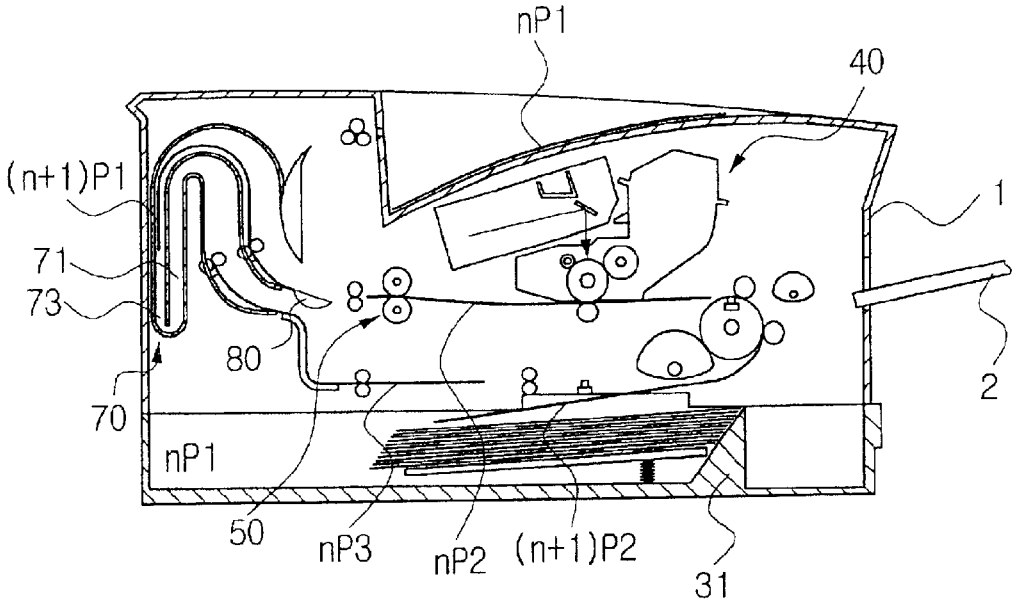

Next, as shown in FIG. 12, an image is printed on one side of the first sheet n+1P1 of the n+1$^{th}$ paper unit at the developing section 40, and the n+1$^{th}$ first sheet n+1P1 passes through the fixing section 50 and is introduced into the second tray 73 to stand by for a certain period (S27). When it is determined by the second sensor 93 that the second sheet nP2 has been passed (S28), the second sheet n+1P2 of the n+1$^{th}$ paper unit is fed from the sheet supplying tray 31 (S29). The third sheet nP3 standing by at the first tray 71 is reversed and delivered to the reversing path L3 (S30).

Figure 13:
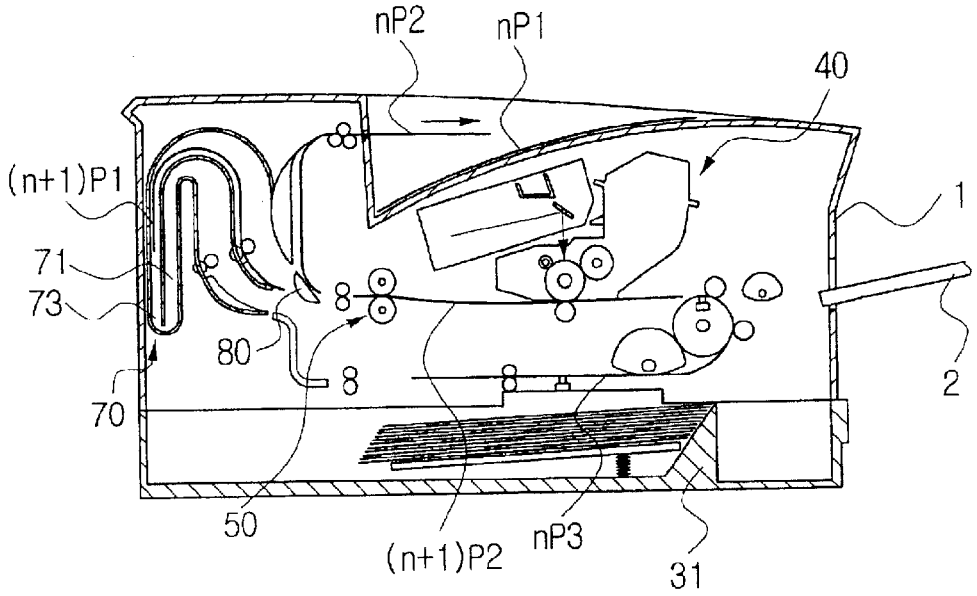

As shown in FIG. 13, when it is determined by the first sensor 91 that the second sheet n+1P2 of the n+1$^{th}$ paper unit has passed therethough (S31), the third sheet nP3 standing by on the reversing path L3 is fed to the feeding path L1 again, and at that time the second sheet nP2 is ejected along the ejecting path L2 to the exterior of the printer (S32).

Figure 14:
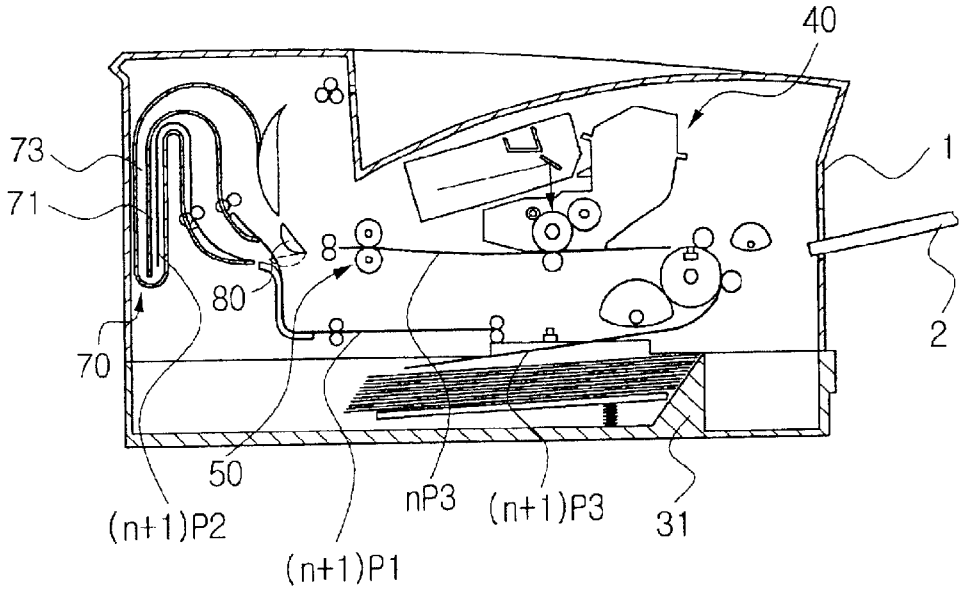

As shown in FIG. 14, the second sheet n+1P2 of the n+1$^{th}$ paper unit is introduced into the first tray 71 and stands by for a certain period (S33). Furthermore, it is determined by the first sensor 91 that the third sheet nP 3 has passed therethrough (S34), and the third sheet n+1P3 of the n+1$^{th}$ paper unit is fed from the supplying tray 31 (S35). Then, the first sheet n+1P1 is reversed at the second tray 73, and delivered to the reversing path L3. The first sheet n+1P1 of the n+1$^{th}$ paper unit stands by after being detected by the second sensor 93 (S36).

Figure 15:
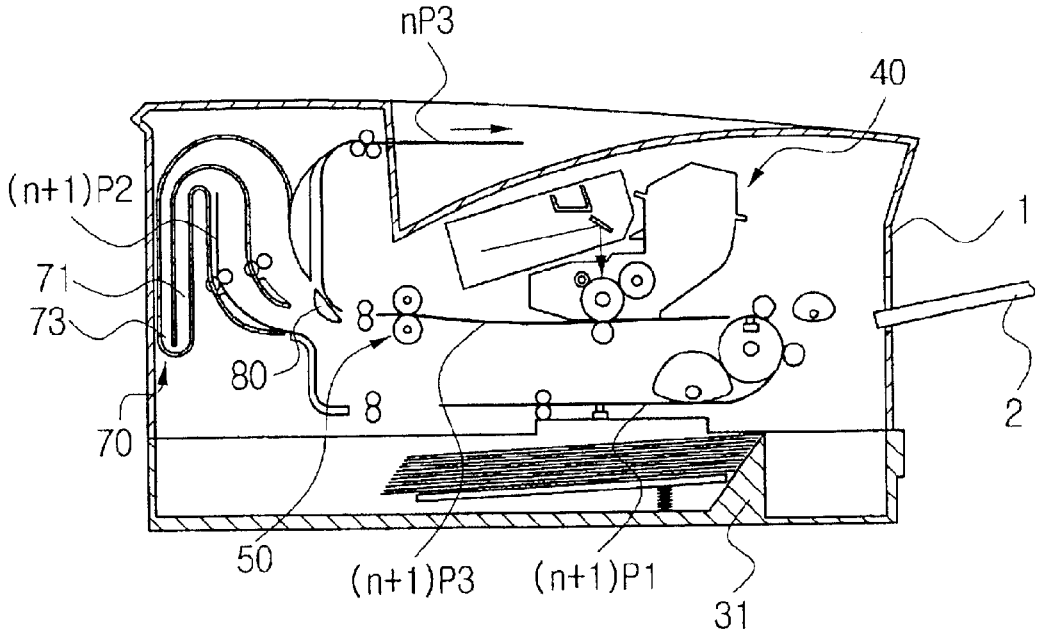

Subsequently, as shown in FIG. 15, when the first sensor 91 confirms the passage of the third sheet n+1P3 (S37), the first sheet n+1P1 standing by on the reversing path L3 is again fed to the feeding path L1 for duplex printing and at the same time the third sheet nP3 is ejected to the exterior (S38).

At some point after step S38, it is checked whether or not additional duplex printing data is inputted (S39). When additional duplex printing data is inputted, steps S20 to S28 are repeated with the grade of the paper unit increased by one, i.e., n=n+1.

Figure 16:
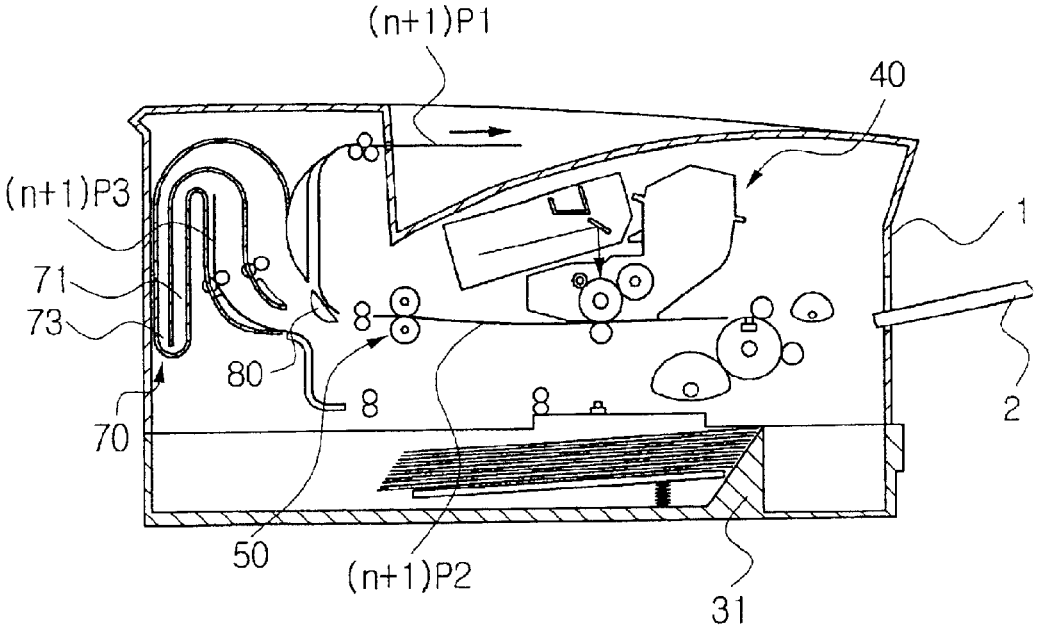

However, when no additional duplex printing data is inputted at step S39, as shown in FIG. 15, the second sheet n+1P2 of the n+1$^{th}$ paper unit is reversed at the first tray 71 and delivered to the reversing path L3 (S40). As shown in FIG. 16, an image is printed on the other side of the n+1$^{th}$ first sheet n+1P1 at the developing section 40 and the first sheet n+1P1 is ejected along the ejecting path L2 to the exterior (S41). The second sheet n+1P2 is again fed via the feeding path L1 to the developing section 40 for duplex printing (S42), and when the first sensor 91 confirms the passage of the second sheet n+1P2, the third sheet n+1P3 is reversed at the second tray 73 and delivered to the reversing path L3 (S43). Then, in sequence, the n+1$^{th}$ second sheet n+1P2 is ejected (S44), the n+1$^{th}$ third sheet n+1P3 is again fed to the developing section 40, and the third sheet n+1P3 is ejected along the ejecting path L2 after the other side thereof has been printed.

As described above, the sheets of the n$^{th}$ paper unit are sequentially fed to print an image on one side of each of the sheets, and the printed sheets are sequentially reversed and fed again. At that time, the sheets of the n+1$^{th}$ paper unit are fed to print an image on one side thereof in such a way that they are interposed between the adjacent two sheets of the n$^{th}$ paper unit, respectively. Then, the sheets of the n$^{th}$ paper unit, on both sides of which images are printed, are ejected to the exterior, and the sheets of the n+1$^{th}$ paper unit, on one side of which an image is printed, is reversed, fed and ejected in the same manner as those of the n$^{th}$ paper unit. That is, the simplex printing and the duplex printing are in turn performed.

Therefore, according to the paper feeding apparatus and method described above, the speed of duplex printing is increased. Furthermore, the duplex printing is readily carried out using the reverse tray mounted in the main body without any separate optional unit which is to be installed to the side of the printer.

In addition, the high temperature sheet from the fixing section is not immediately delivered to the developing section 40 for duplex printing, but is delivered after standing by for a certain period. Thus, the temperature of the sheet is decreased, thereby preventing the poor print quality due to the variation of the properties of the toner and the increase of the surface temperature of the photosensitive roller, as in the prior art.

Although in the above-described embodiment, the paper unit with three sheets is described, this is only an example and the number of sheets may be varied according to the size or capacity of the printer.

According to the image forming apparatus of the present invention as described above, the duplex printing and the simplex printing can continuously and sequentially be performed using the reverse tray mounted therein. This faster printing increases the convenience of a user.

Although a few preferred embodiments of the present invention have been shown and described, it will be appreciated by those skilled in the art that changes may be made in these embodiments without departing from the principles and spirit of the invention, the scope of which is defined in the claims and their equivalents.

What is claimed is:

1. A paper feeding apparatus for use in a printer, comprising:

a sheet feeding path between a sheet feeding section and a developing section;

a sheet ejecting path disposed such that a plurality of sheets on which an image is printed at the developing section is fed to the sheet ejecting path via a fixing section and an ejecting roller;

a reversing path to feed the sheets from the sheet ejecting path to the sheet feeding path;

a reversing tray disposed between the sheet ejecting path and the reversing path to feed the sheets from the reversing path to the sheet feeding path; and a guide member rotatably mounted between the sheet ejecting path and the reversing tray, to direct the sheets to the sheet ejecting path or the reversing tray and to guide the sheets from the reversing tray to the reversing path.

2. The apparatus of claim 1, wherein the reversing tray comprises:

a first tray at which an odd numbered one of the sheets stands by for a certain period, the first tray to reverse and deliver the odd numbered sheet to the reversing path; and a second tray at which an even numbered one of the sheets stands by for a certain period, the second tray to reverse and deliver the even numbered sheet to the reversing path.

3. The apparatus of claim 2, wherein the guide member is rotatable sheet by sheet to a first position to direct one of the sheets to the sheet ejecting path, a second position to direct the one of the sheets to the first tray, and a third position to direct the one of the sheets to the second tray.

4. The apparatus of claim 3, wherein the guide member comprises:

a first guide surface to guide the one of the sheets to either the ejecting path or one of the first and second trays; and a second surface, formed on an opposite side of the guide member from the first guide surface, to guide the one of the sheets from the one of the first or second trays to the reversing path.

5. The apparatus of claim 1, further comprising:

a first sensor disposed on the sheet feeding path, to detect one of the sheets introduced into the developing section; and a second sensor disposed on the reversing path, to detect one of the sheets before being introduced into the sheet feeding path.

6. A paper feeding method to duplex print in a printer, the method comprising:

sequentially feeding a plurality of sheets comprising an $n^{th}$ paper unit from a sheet supplying section to a developing section;

printing images at the development section on a first side of the sheets comprising the $n^{th}$ paper unit;

sequentially reversing the printed sheets;

feeding the reversed sheets to the developing section at an interval;

feeding sheets comprising an $n+1^{th}$ paper unit, interposed between adjacent ones of the reversed sheets of the $n^{th}$ paper unit; and printing images at the development section on a second side of the sheets comprising the $n^{th}$ paper unit and ejecting the printed sheets to an exterior of the printer.

7. The method of claim 6, further comprising:

printing images at the development section on a first side of the sheets comprising the $n+1^{th}$ paper unit;

sequentially reversing the printed sheets of the $n+1^{th}$ paper unit; and determining whether there is input printing data when the sheets of the $n+1^{th}$ paper unit are reversed, wherein if it is determined that there is input data, sheets comprising an $n+2^{nd}$ paper unit are fed, interposed between adjacent ones of the reversed sheets of the $n+1^{st}$ paper unit, and images are printed on a second side of the sheets comprising the $n+1^{st}$ paper unit.

8. The method of claim 6, further comprising:

printing images at the development section on a first side of the sheets comprising the $n+1^{th}$ paper unit;

sequentially reversing the printed sheets of the $n+1^{th}$ paper unit;

determining whether there is input printing data when the sheets of the $n+1^{th}$ paper unit are reversed;

continuously feeding the sheets of the $n+1^{th}$ paper unit to the developing section when it is determined that there is no input printing data; and continuously ejecting the fed sheets of the $n+1^{th}$ paper unit.

9. The method of claim 6, wherein the sequentially feeding the sheets comprising the $n^{th}$ paper unit comprises:

feeding a first sheet of the $n^{th}$ paper unit from the sheet supplying section;

determining whether the first sheet of the $n^{th}$ paper unit has passed by a feeding sensor disposed between the sheet supplying section and the developing section;

feeding a second sheet of the $n^{th}$ paper unit from the sheet supplying section when the first sheet of the $n^{th}$ paper unit has passed by the feeding sensor, determining whether the second sheet of the $n^{th}$ paper unit has passed by the feeding sensor; and feeding a third sheet of the $n^{th}$ paper unit from the sheet supplying section when the second sheet of the $n^{th}$ paper unit has passed by the feeding sensor.

10. The method of claim 6, wherein the reversing of the printed sheets comprises:

reversing a first sheet of the $n^{th}$ paper unit, a first image being printed at the developing section on a first side thereof, into an odd reversing tray;

introducing a second sheet of the $n^{th}$ paper unit, a second image being printed at the developing section on a first side thereof, into an even reversing tray, the second sheet standing by therein for a certain period;

introducing a third sheet of the $n^{th}$ paper unit into the odd reversing tray;

reversing the second sheet of the $n^{th}$ paper unit standing by in the even reversing tray when a first sheet of $n+1^{th}$ paper unit is fed from the sheet supplying section; and reversing the third sheet of the $n^{th}$ paper unit, standing by in the odd reverse tray, when a second sheet of the $n+1^{th}$ paper unit is fed from the sheet supplying section.

11. The method of claim 6, wherein the feeding of the reversed sheets comprises:

feeding a third sheet of the $n^{th}$ paper unit from the sheet supplying section to the developing section;

feeding a reversed first sheet of the $n^{th}$ paper unit, a first image being printed on a first side thereof, to the developing section;

feeding a first sheet of the $n+1^{th}$ paper unit from the sheet supplying section to the developing section;

feeding a reversed second sheet of the $n^{th}$ paper unit, a second image being printed on a first side thereof, to the developing section;

feeding a second sheet of the $n+1^{th}$ paper unit from the supplying section to the developing section; and feeding a reversed third sheet of the $n^{th}$ paper unit, a third image being printed on a first side thereof, to the developing section.

12. The method of claim 6, wherein the feeding of the sheets comprising the $n+1^{th}$ paper unit comprises:

feeding a first sheet of the $n^{th}$ paper unit, a first one of the images being printed on a first side thereof, to the developing section;

feeding a first sheet of the $n+1^{th}$ paper unit from the sheet supplying section to the developing section;

feeding a second sheet of the $n^{th}$ paper unit, a second one of the images being printed on a first side thereof, to the developing section;

feeding a second sheet of the $n+1^{th}$ paper unit from the sheet supplying section to the developing section;

feeding a third sheet of the $n^{th}$ paper unit, a third one of the images being printed on a first side thereof, to the developing section; and feeding the third sheet of the n+1 th paper unit from the sheet supplying section to the developing section.

13. A paper feeding apparatus to feed a plurality of sheets, comprising:

a developing unit to print images on the sheets;

a feeding unit to feed the sheets to the developing unit; and a reversing unit comprising first and second trays, to receive the sheets from the development unit and to feed the sheets from the first and second trays to the feeding unit.

14. The paper feeding apparatus of claim 13, further comprising:

an ejecting unit to feed the sheets to an outside of the printer; and a guide unit to guide the sheets from the developing unit to either the ejecting unit, the first tray or the second tray.

15. The paper feeding apparatus of claim 14, wherein:

the guide unit guides a first sheet, having first and second images respectively printed on first and second sides thereof, to the ejecting unit.

16. The paper feeding apparatus of claim 15, wherein:

the guide unit guides a second sheet, having a third image printed on a first side thereof, to the first tray; and the guide unit guides a third sheet, having a fourth image printed on a first side thereof, to the second tray.

17. The paper feeding apparatus of claim 16, wherein:

the feeding unit feeds the first sheet to the developing unit to print the first image;

the feeding unit feeds the second sheet to the developing unit to print the third image;

the feeding unit re-feeds the first sheet to the developing unit to print the second image;

the feeding unit feeds a fourth sheet to the developing unit to print a fifth image on a first side thereof; and the feeding unit re-feeds the second sheet to the developing unit to print a sixth image on a second side thereof.

18. A paper feeding method to duplex print in a printer, comprising:

feeding sheets of a first paper unit from a feeding unit to a developing unit;

printing images on first sides of the sheets of the first paper unit;

alternately feeding the sheets of the first paper unit to first and second trays; and re-feeding the sheets of the first paper unit from the first and second trays to the feeding unit.

19. The paper feeding method of claim 18, further comprising:

printing images on second sides of the sheets of the first paper unit; and feeding sheets of a second paper unit from the feeding unit to the developing unit in between the re-fed sheets of the first paper unit.

20. The paper feeding method of claim 19, further comprising:

guiding the sheets of the first paper unit having images printed on the second sides to an outside of the printer.

21. The paper feeding method of claim 20, wherein the alternately feeding of the sheets comprises selectively moving a guide to first and second positions to feed the sheets to the first and second trays, respectively, and the re-feeding of the sheets comprises guiding the re-fed sheets with the guide.

22. The paper feeding method of claim 21, wherein the guiding of the sheets to the outside comprises moving the guide to a third position.

* * * * *